United States Patent [19]

Muzzell

[11] 4,325,542

[45] Apr. 20, 1982

[54] SEAT CONSTRUCTION

[75] Inventor: Stephen E. Muzzell, Ferndale, Mich.

[73] Assignee: Gulf & Western Manufacturing Company, Southfield, Mich.

[21] Appl. No.: 174,643

[22] Filed: Aug. 1, 1980

[51] Int. Cl.[3] ..... F16F 3/02

[52] U.S. Cl. ..... 267/85; 267/106

[58] Field of Search ..... 267/102–104, 267/106, 109, 110, 112, 85; 297/456

[56] References Cited

U.S. PATENT DOCUMENTS 2,875,818 3/1959 Staples et al. ..... 267/85

3,888,473 6/1975 Mandusky et al. ..... 267/102

FOREIGN PATENT DOCUMENTS 2406732 8/1974 Fed. Rep. of Germany ..... 267/102

*Primary Examiner*—Duane A. Reger

*Attorney, Agent, or Firm*—Barnes, Kisselle, Raisch & Choate

[57] ABSTRACT

A seat construction comprising a frame having first and second spaced rails and a seat suspension mat comprising covered first and second border wires and a plurality of longitudinally spaced transversely extending spaced wires having their ends attached to the border wires, said first border wire being attached to the first rail and the second border wire being attached to the second rail. First and second auxiliary coated wires extending longitudinally and generally parallel to the border wires. Each transversely extending wire is wound around each of the auxiliary longitudinal wires, thereby defining a first portion extending upwardly from the first border wire to the first auxiliary wire, a second portion extending from the first auxiliary wire to the second auxiliary wire, and a sinuous portion extending from the second auxiliary wire to the second border wire. When a load is applied generally perpendicular to the general plane of the suspension mat, the wrapped portions of the wire about the auxiliary longitudinal wires are wound to varying degrees about the auxiliary longitudinal wires and the sinusoidal portions of the wires extend to provide continued resilient suspension.

9 Claims, 10 Drawing Figures

SEAT CONSTRUCTION

This invention relates to seat constructions for automotive and furniture applications.

BACKGROUND AND SUMMARY OF THE INVENTION

In seat constructions for automobiles and furniture, it is common to utilize various spring or suspension members with auxiliary components to provide the desired spring or resilient action. The use of a plurality of components not only increases the cost of the seat but makes the seat more difficult to assemble.

Accordingly, among the objects of the present invention are to provide a seat construction which will produce the desired level of support and resilient suspension; which comprises a single component attached to a seat frame and does not require additional components for installation or support; which is resilient enough to permit easy installation in the seat frame and will inherently retain its assembly to the seat frame without auxiliary components; which is easily orientable to the desired position in the seat frame; which utilizes a single suspension element that can be easily nested for shipment and bulk handling; and which approaches normal anatomic configuration so that the quantity of required padding material is reduced.

In accordance with the invention, the seat construction comprises a seat suspension mat comprising covered first and second border wires and a plurality of longitudinally spaced transversely extending spaced wires having their ends attached to said border wires. The first border wire being attached to a first rail of a frame and said second border wire is attached to a second rail of a frame. First and second auxiliary coated wires extend longitudinally and generally parallel to the border wires. Each transversely extending wire being wound around each of the auxiliary longitudinal wires, thereby defining a first portion extending upwardly from the first border wire to the first auxiliary wire, a second portion extending from the first auxiliary wire to the second auxiliary wire, and a sinuous portion extending from the second auxiliary wire to the second border wire. When a load is applied generally perpendicular to the general plane of the suspension mat, the wrapped portions of the wire about the auxiliary longitudinal wires are wound to varying degrees about the auxiliary longitudinal wires and the sinusoidal portions of the wires extend to provide continued resilient suspension.

DESCRIPTION

Figure 1:
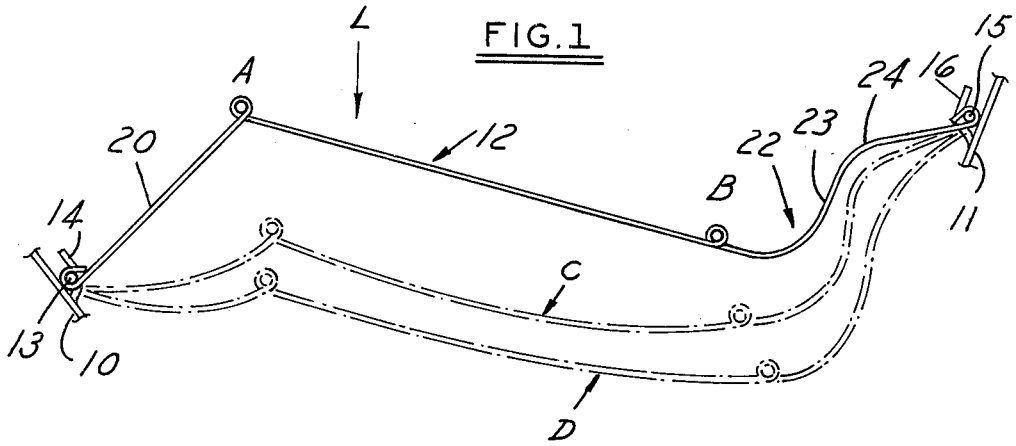
FIG. 1 is a side elevational view of a seat construction embodying the invention.
Figure 2:
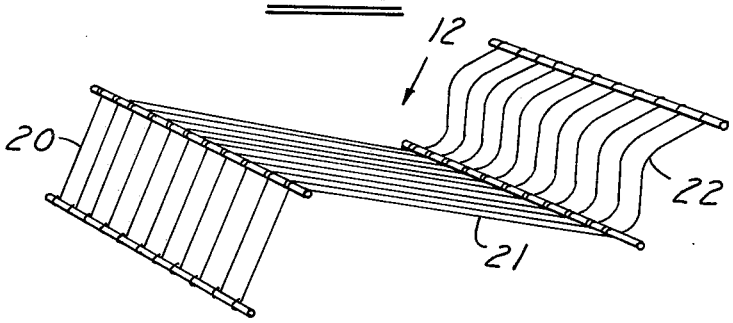
FIG. 2 is a perspective view of the suspension element.
Figure 3:
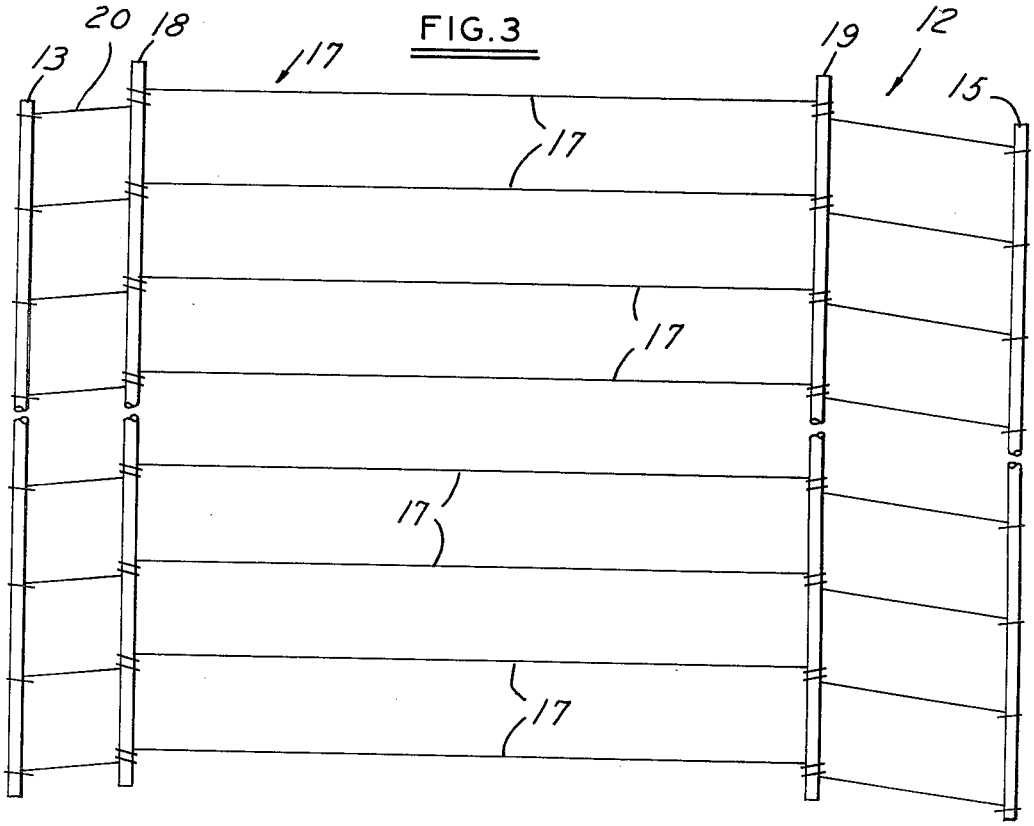
FIG. 3 is a plan view of the seat construction.

Referring to FIGS. 1–3, the seat construction embodying the invention is adapted to be used in automobiles or furniture for the horizontal or vertical support. As shown in FIG. 1, the seat comprises front and rear rails 10, 11 between which a suspension mat or element 12 is supported. The suspension mat 12 comprises a front or first border wire 13 comprising an oil tempered wire which is plastic or paper coated that is hooked on the hooks 14 of the front rail 10. The mat 12 further includes a rear longitudinal wire 15 which is also made of oil tempered wire that is plastic or paper coated and is hooked into hooks 16 of the rear rail 11. The suspension mat 12 further includes a plurality of transversely extending longitudinally spaced oil tempered wires 17 that have their free ends wound around the border wires 13, 15, and intermediate portions wound twice around auxiliary or bolster longitudinal wires 18, 19, each of which is made of oil tempered wire that is plastic or paper coated. Thus, the suspension mat includes a first portion 20 extending between wires 13, 18 upwardly and rearwardly, a second portion 21 extending downwardly and rearwardly between wires 18, 19 and a third portion 22 that is sinuous, preferably but not necessarily comprising a single sinuous undulation extending between the wires 19, 15. Each sinuous portion 22 includes a downwardly extending portion 23 adjacent wire 19 and upwardly extending portion 24 adjacent wire 15.

As a downward load L is placed on the suspension mat, the double wraps at A and B are wound up to a greater or lesser degree balancing the variable load L and portions 20, 21 bend downwardly between their ends. In this mode, shown in broken lines in FIG. 1 at a typical position C the sinusoidal portions 22 extend only slightly and the peak at A continues to exert a satisfactory level of support, for example, in the thigh area. In jounce modes or conditions, shown in broken lines at a typical position D as the gravitational forces on the occupant increase, the sinusoidal form elongates to provide continuous resilient suspension.

Figure 4:
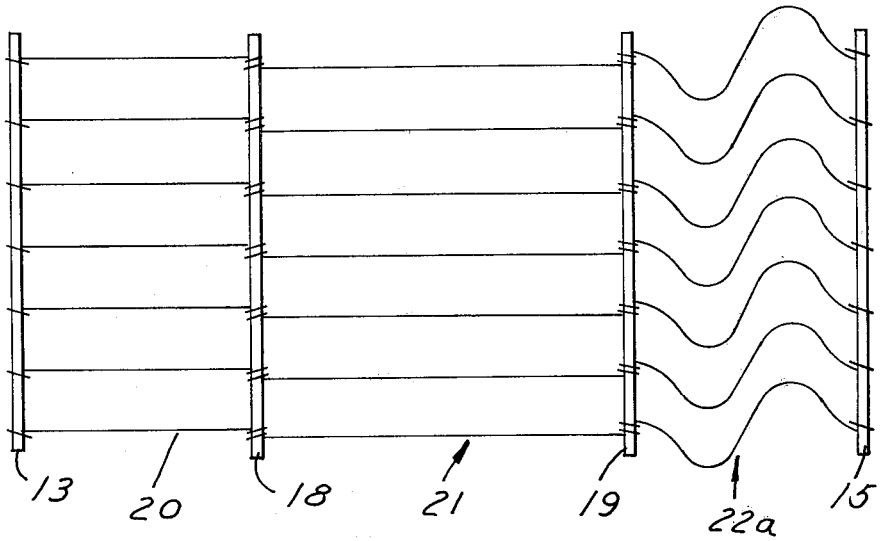
FIG. 4 is a plan view of a modified form of suspension element.
Figure 5:
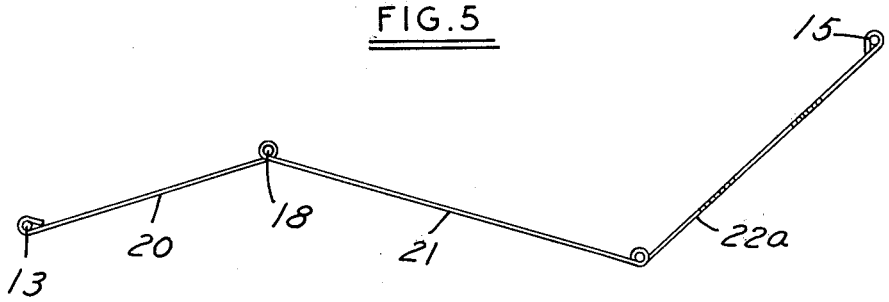
FIG. 5 is an elevational view of the suspension element shown in FIG. 4.

In the form of the invention shown in FIGS. 4 and 5, the sinusoidal portions **22*a* lie in an upwardly rising flat plane from wires 19 to wire 15 rather than in a plane containing the wire portion 20**.

Figure 6:
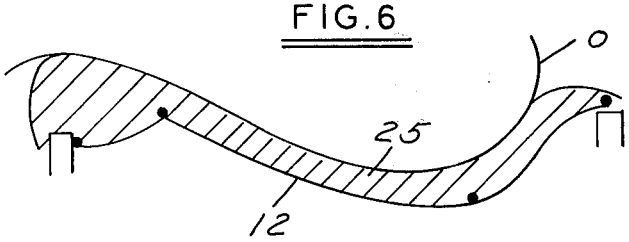
FIG. 6 is a diagrammatic view showing the padding material in position.

As shown in FIG. 6, a layer of padding material 25, such as foam, is applied to the suspension mat so that when the upholstery material is added, the seat approaches normal anatomic configuration to the occupant shown as O.

Figure 7:
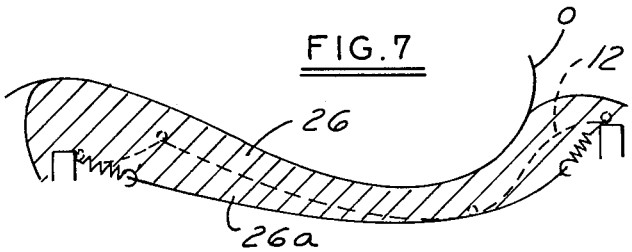
FIG. 7 is a diagrammatic view showing the relative amount of padding material used in the seat construction embodying the invention as contrasted to prior seat construction.

As a result there is a substantial saving in padding material over a conventional seat wherein the padding material is applied to a flat suspension mat 26 as shown in FIG. 7. Thus, the seat construction embodying the invention eliminates the need for the additional padding material **26*a* below the position of the suspension mat 12**, shown in broken lines.

Figure 8:
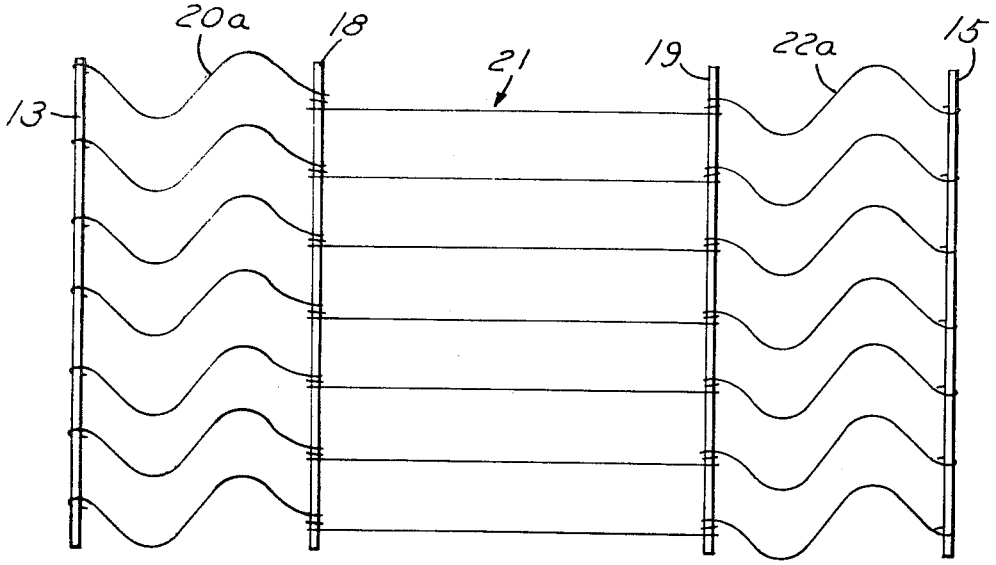
FIG. 8 is a plan view of a modified form of suspension element.
Figure 9:
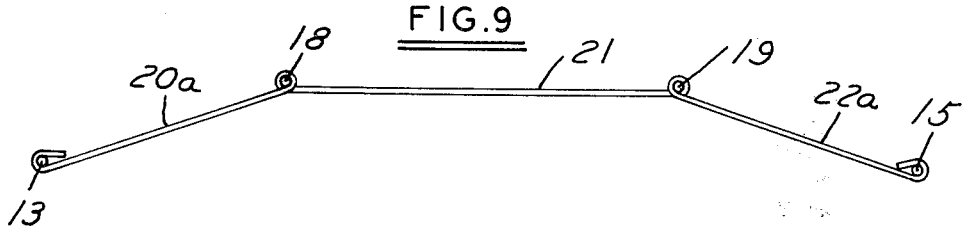
FIG. 9 is a side elevation view of the suspension element shown in FIG. 8.

In the form of the suspension mat shown in FIGS. 8 and 9, the sinusoidal portions **20*a* lie in a flat plane rising from wire 13 to wire 18 and sinusoidal portions 22*a* lie in a flat plane descending from wire 19 to wire 15**.

Figure 10:
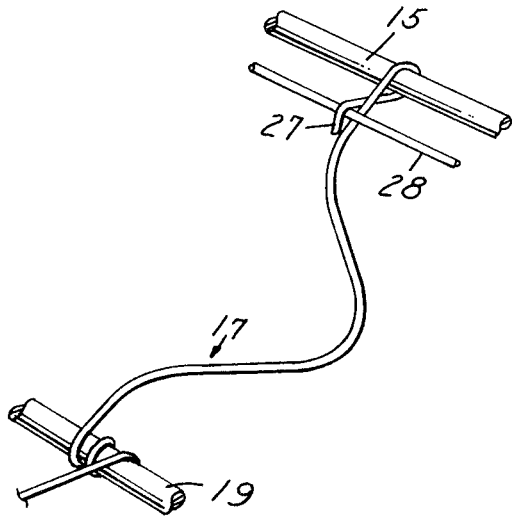
FIG. 10 is a fragmentary perspective view of a modified form of suspension element.

In order to facilitate the fastening of upholstery fabric to the seat, the construction shown in FIG. 10 may be used in any of the forms of the invention. In accordance with this construction, the free ends of the wires 17 are wound around the border wires 13, 15 and thereafter snapped beneath auxiliary longitudinal wires 28 overlying the wires 17 adjacent to the respective border wires 13, 15. The ends of the fabric can be fastened directly to the auxiliary wires.

I claim:

1. A seat construction comprising a frame having first and second spaced rails, a seat suspension mat comprising covered first and second coated border wires and a plurality of longitudinally spaced transversely extending spaced wires having their ends attached to said border wires, said first border wire being attached to said first rail and said second border wire being attached to said second rail, first and second auxiliary coated wires extending longitudinally and generally parallel to said border wires, each said transversely extending wire being wound around each of said auxiliary longitudinal wires, thereby defining a first portion extending upwardly from said first border wire to said first auxiliary wire, a second portion extending from said first auxiliary wire to said second auxiliary wire, and a sinuous portion extending from said second auxiliary wire to said second border wire such that when a load is applied generally perpendicular to the general plane of the suspension mat, the wrapped portions of the wire about the auxiliary longitudinal wires are wound to varying degrees about the auxiliary longitudinal wires and the sinusoidal portions of the wires extend to provide continued resilient suspension.

2. The seat construction set forth in claim 1 wherein each said wire is wound around its respective auxiliary longitudinal wires twice.

3. The seat construction set forth in any of claims 1 and 2 wherein said sinusoidal portion extends substantially coplanar with said first and second portions.

4. The seat construction set forth in any of claims 1 and 2 wherein said sinusoidal portions lie in a plane containing said second auxiliary longitudinal wire and said second border wire.

5. For use in a seat construction, a seat suspension mat comprising covered first and second coated border wires and a plurality of longitudinally spaced transversely extending spaced wires having their ends attached to said border wires, said first border wire being adapted to be attached to a first rail of a frame and said second border wire being adapted to be attached to a second rail of a frame, first and second auxiliary coated wires extending longitudinally and generally parallel to said border wires, each said transversely extending wire being wound around each of said auxiliary longitudinal wires, thereby defining a first portion extending upwardly from said first border wire to said first auxiliary wire, a second portion extending from said first auxiliary wire to said second auxiliary wire, and a sinuous portion extending from said second auxiliary wire to said second border wire such that when a load is applied generally perpendicular to the general plane of the suspension mat, the wrapped portions of the wire about the auxiliary longitudinal wires are wound to varying degrees about the auxiliary longitudinal wires and the sinusoidal portions of the wires extend to provide continued resilient suspension.

6. The seat construction set forth in claim 5 wherein each said wire is wound around its respective auxiliary longitudinal wires twice.

7. The seat construction set forth in any of claims 5 and 6 wherein said sinusoidal portion extends substantially coplanar with said first and second portions.

8. The seat construction set forth in any of claims 5 and 6 wherein said sinusoidal portions lie in a plane containing said second auxiliary longitudinal wire and said second border wire.

9. The seat construction set forth in any of claims 1 and 5 including an auxiliary longitudinal wire overlying and adjacent each border wire, the free ends of the transversely extending wires extending beneath and engaging the auxiliary wires.

* * * * *